US009315283B2

(12) United States Patent
Neeser et al.

(10) Patent No.: US 9,315,283 B2
(45) Date of Patent: Apr. 19, 2016

(54) STRAPPING DEVICE WITH AN ENERGY STORAGE MEANS

(75) Inventors: Mirco Neeser, Ennetbaden (CH); Roland Widmer, Bremgarten (CH); Flavio Finzo, Wuerenlos (CH)

(73) Assignee: Signode Industrial Group LLC, Glenview, IL (US)

( * ) Notice: Subject to any disclaimer, the term of this patent is extended or adjusted under 35 U.S.C. 154(b) by 592 days.

(21) Appl. No.: 12/989,181

(22) PCT Filed: Jan. 6, 2009

(86) PCT No.: PCT/CH2009/000003

§ 371 (c)(1),
(2), (4) Date: Nov. 23, 2010

(87) PCT Pub. No.: WO2009/129635

PCT Pub. Date: Oct. 29, 2009

(65) Prior Publication Data

US 2011/0056391 A1 Mar. 10, 2011

(30) Foreign Application Priority Data

Apr. 23, 2008 (CH) ..... 647/08

(51) Int. Cl.
*B65B 13/32* (2006.01)
*B65B 13/22* (2006.01)
*B65B 13/18* (2006.01)

(52) U.S. Cl.
CPC ..... *B65B 13/18* (2013.01); *B65B 13/187* (2013.01); *B65B 13/22* (2013.01); *B65B 13/322* (2013.01); *B65B 13/327* (2013.01)

(58) Field of Classification Search
CPC ..... B65B 13/18; B65B 13/32; B65B 13/322; B65B 13/187; B65B 13/22
USPC ..... 100/29, 30, 32, 33 R, 33 PB
See application file for complete search history.

(56) References Cited

U.S. PATENT DOCUMENTS 3,367,374 A 2/1968 Meier et al.
3,654,033 A 4/1972 Angarola et al.

(Continued)

FOREIGN PATENT DOCUMENTS

CN 1253099 5/2000
CN 1558842 12/2004

(Continued)

OTHER PUBLICATIONS

Lithium ion technology: shaping power tool. By Bender, In Air conditioning, heating, and refrigeration news. vol. 228, Issue, 14, p. 18. Jul. 31, 2006).*

(Continued)

*Primary Examiner* — Jimmy T Nguyen
*Assistant Examiner* — Chwen-Wei Su
(74) *Attorney, Agent, or Firm* — Neal, Gerber & Eisenberg LLP

(57) ABSTRACT

A mobile strapping device for strapping packaged goods with wrap-around strap, comprising a tensioner for applying a strap tension to a loop of a wrapping strap, and a connector for producing a connection in two areas of the loop of the wrapping strap disposed one on top of the other, and a chargeable energy storage means for storing energy that can be released as drive energy for motorized drive motions at least for the friction welder for producing a friction welded connection and/or for the tensioner, is intended to have high functional reliability and ease of handling despite the possibility of automated production of wrapped straps, at least to a large extent. To this end, it is proposed that the energy storage means of the strapping device comprise a lithium ion battery for providing energy for driving a connector designed as a friction welder.

18 Claims, 9 Drawing Sheets

(56) References Cited

U.S. PATENT DOCUMENTS

| | | | | |
|---|---|---|---|---|
| 4,011,807 | A | 3/1977 | Kobiella | |
| 4,015,643 | A | 4/1977 | Cheung | |
| 4,313,779 | A | 2/1982 | Nix | |
| 4,450,032 | A | 5/1984 | Wehr | |
| 4,572,064 | A | 2/1986 | Burton et al. | |
| 4,707,390 | A | 11/1987 | Cheung | |
| 4,776,905 | A * | 10/1988 | Cheung et al. | 156/73.5 |
| 5,133,532 | A | 7/1992 | Figiel et al. | |
| 5,146,847 | A | 9/1992 | Lyon et al. | |
| 5,155,982 | A | 10/1992 | Boek et al. | |
| 5,159,218 | A * | 10/1992 | Murry et al. | 310/68 B |
| 5,516,022 | A | 5/1996 | Annis, Jr. | |
| 5,689,943 | A | 11/1997 | Wehr | |
| 5,690,023 | A | 11/1997 | Stamm et al. | |
| 5,798,596 | A * | 8/1998 | Lordo | 310/216.016 |
| 5,809,873 | A | 9/1998 | Chak et al. | |
| 6,003,578 | A | 12/1999 | Chang | |
| 6,109,325 | A | 8/2000 | Chang | |
| 6,308,760 | B1 * | 10/2001 | Finzo et al. | 156/494 |
| 6,332,306 | B1 | 12/2001 | Finzo et al. | |
| 6,405,766 | B1 | 6/2002 | Benjey | |
| 6,516,715 | B1 | 2/2003 | Reiche | |
| 6,578,337 | B2 | 6/2003 | Scholl et al. | |
| 6,606,766 | B2 | 8/2003 | Ko | |
| 6,644,713 | B2 | 11/2003 | Del Pozo Abejon et al. | |
| 6,715,375 | B2 | 4/2004 | Nestler | |
| 6,732,638 | B1 | 5/2004 | Rometty et al. | |
| 6,817,159 | B2 | 11/2004 | Sakaki et al. | |
| 6,918,235 | B2 | 7/2005 | Nix | |
| 7,011,000 | B2 | 3/2006 | Kushida et al. | |
| 7,249,862 | B2 * | 7/2007 | Shirane | 362/119 |
| 7,312,609 | B2 | 12/2007 | Schmollngruber et al. | |
| 7,456,608 | B2 | 11/2008 | Kageler et al. | |
| 8,198,839 | B2 | 6/2012 | Katou et al. | |
| 8,378,600 | B2 | 2/2013 | Katou et al. | |
| 2002/0100146 | A1 | 8/2002 | Ko | |
| 2002/0129717 | A1 | 9/2002 | Helland et al. | |
| 2003/0145900 | A1 | 8/2003 | Jensen et al. | |
| 2005/0279198 | A1 | 12/2005 | Kushida et al. | |
| 2006/0108180 | A1 | 5/2006 | Grach et al. | |
| 2006/0192527 | A1 * | 8/2006 | Kageler et al. | 320/115 |
| 2009/0013656 | A1 | 1/2009 | Nasiatka et al. | |
| 2012/0160364 | A1 | 6/2012 | Katou et al. | |

FOREIGN PATENT DOCUMENTS

| | | | |
|---|---|---|---|
| CN | 1859999 | A | 11/2006 |
| CN | 201411061 | | 2/2010 |
| DE | 19751861 | | 1/1999 |
| DE | 10026200 | | 11/2001 |
| DE | 20321137 | U1 | 1/2006 |
| DE | 202011050797 | | 11/2011 |
| EP | 0480627 | A1 | 4/1992 |
| EP | 0744343 | | 11/1996 |
| EP | 0949146 | | 10/1999 |
| EP | 0997377 | | 5/2000 |
| EP | 0999133 | | 5/2000 |
| EP | 1316506 | | 6/2003 |
| EP | 1413519 | A1 * | 4/2004 |
| JP | S5290398 | A | 7/1977 |
| JP | S541238 | | 1/1979 |
| JP | S5638220 | A | 4/1981 |
| JP | 6322320 | A | 1/1988 |
| JP | H05198241 | | 8/1993 |
| JP | H07300108 | | 10/1996 |
| JP | 08324506 | A | 12/1996 |
| JP | 09283103 | A | 10/1997 |
| JP | 3044132 | | 5/2000 |
| JP | 2000128115 | A | 5/2000 |
| JP | 20000128113 | A | 5/2000 |
| JP | 3227693 | | 11/2001 |
| JP | 3242081 | | 12/2001 |
| JP | 2002235830 | A | 8/2002 |
| JP | 2003170906 | | 6/2003 |
| JP | 2003231291 | | 8/2003 |
| JP | 2003231291 | A | 8/2003 |
| JP | 2003348899 | A | 12/2003 |
| JP | 2004108593 | | 4/2004 |
| JP | 3548622 | | 7/2004 |
| JP | 2004241150 | | 8/2004 |
| JP | 2004323111 | | 11/2004 |
| JP | 2007276042 | A | 10/2007 |
| JP | 4406016 | | 1/2010 |
| KR | 840002211 | | 12/1984 |
| KR | 20000029337 | | 5/2000 |
| RU | 1772784 | C | 10/1992 |
| RU | 2118277 | C1 | 8/1998 |
| RU | 2161773 | | 1/2001 |
| RU | 2004115639 | A | 1/2006 |
| RU | 2355281 | | 5/2009 |
| SU | 1134117 | A3 | 1/1985 |
| WO | 2006048738 | A1 | 5/2006 |
| WO | WO 2007/116914 | | 10/2007 |
| WO | WO 2009/129633 | | 10/2009 |
| WO | WO 2009/129636 | | 10/2009 |

OTHER PUBLICATIONS

Brushless DC Motor Drives, by Ali Emadi, In Energy-Efficient Electrical Motors, 3rd Ed., revised and expaned, Aug. 2004, p. 270-272. CRC Press & Marcel Dekker.*

ISR for PCT/CH2009/000003 mailed Jun. 22, 2009.

A Russian Decision to Grant, dated Aug. 31, 2012, issued in SU Application No. 2010147639.

Japanese Office Action issued in corresponding Application No. JP-2011-505337, dated Mar. 27, 2013.

Korean Office Action dated May 18, 2015 for Korean Application No. 10-2010-7023730 (6 pages).

* cited by examiner

STRAPPING DEVICE WITH AN ENERGY STORAGE MEANS

RELATED APPLICATIONS

The present application is national phase of International Application Number PCT/CH2009/000003 filed Jan. 6, 2009, and claims priority from, Swiss Application Number 647/08 filed Apr. 23, 2008.

The invention relates to a mobile strapping device for strapping packaged goods with a wrap-around strap, comprising a tensioner for applying a strap tension to a loop of a wrapping strap, as well as a connector for producing a connection at two areas of the loop of wrapping strap disposed one on top of the other, and a chargeable energy storage means for storing energy that can be released as drive energy at least for the connector and/or tensioner.

Such mobile strapping devices are used for strapping packaged goods with a plastic strap. For this a loop of the plastic strap is placed around the packaged goods. Generally the plastic strap is obtained from a storage roll. After the loop has been completely placed around the packaged goods, the end area of the strap overlaps a section of the strap loop. The strapping device is then applied at this dual-layer area of the strap, the strap clamped into the strapping device, a strap tension applied to the strap loop by the strapping device and a seal produced on the loop between the two strap layers by the connector. For this various connecting technologies are possible, including friction welding. In the case of the latter, a friction shoe moving in an oscillating manner is pressed onto the area of two ends of the strap loop. The pressure and the heat produced by the movement briefly locally melt the strap which generally contains a plastic. This produces a durable connection between the two strap layers which can only be broken with a large amount of force. The loop is then separated from the storage roll. The packaged goods are thus strapped.

For their energy supply strapping devices of this type generally have a chargeable and possibly interchangeable storage battery with which direct current motors are supplied with electrical energy. In the portable mobile strapping devices the direct current motors envisaged for producing drive movements of the tensioner and/or welding device.

Strapping devices of this type are often in continuous use in industry for packaging goods. Therefore as simple operation of the strapping devices as possible is aimed for. In this way on the one hand a high level of functional reliability, associated with high-quality strapping, and on the other hand as little effort as possible for the operator should be assured. Previously known strapping device cannot fully satisfy these requirements.

The aim of the invention is therefore to create a mobile strapping device of the type set out in the introductory section, which in spite of the possibility of at least largely automated production of wrapped straps, exhibits a high level of functional reliability and good handling properties.

In accordance with the invention this objective is achieved with a mobile strapping device in accordance with the introductory section in that the energy storage means has a lithium-ion storage battery which provides energy to drive a connector designed in the form of a friction welder. It has been shown that particularly good functional reliability can be achieved with such storage batteries as these storage batteries provide sufficient energy to carry out a large number of strapping cycles with mobile strapping device, even if strap tensions are applied and at least largely automated strapping procedures with motorised drive movements are be carried out.

In order to weld PP or PET straps, welding shoe frequencies of approx. 250-350 Hz with a pressing pressure of 300-350 N are required. In order to achieve these values a drive-side rotational speed of an eccentric tappet driving the welding shoe of approx. 6000 rpm to 7000 rpm is necessary. Ideally with these initial values a welding procedure takes place over a duration of 1.5 seconds to 2 seconds. If the eccentric shaft speed falls below the value of 6000 rpm, the band seal quality deteriorates considerably.

Within the framework of the invention it has been shown that the prematurely deteriorating connection quality observed in conventional manual strapping device, even though the storage batteries are not even 60% discharged, does not occur in his manner with lithium ion storage batteries.

Lithium ion storage batteries can provide the voltage require for a high speed for considerably longer. In this way, compared with other storage batteries of similar size, lithium ion storage batteries provide the desired reliability for considerably longer i.e. in the case of a much higher of strapping procedure and friction weld. Only shortly before full consumption of the storage energy does the supply voltage provided by lithium ion storage batteries fall to values at which friction welding should not be carried out. As the time at which the user is requested to charge the storage battery shortly before full discharge by a corresponding signal on the strapping device corresponds with the time at which the storage battery no longer produces good quality friction weld, in contrast to conventional storage batteries the recharging signal can be seen by the user as an indication that as of then the required quality of subsequent strappings is no longer given.

As lithium ion storage batteries have a much higher energy density than conventional storage batteries, these advantages can even be achieved in relation to the dimensions of smaller storage batteries. The resulting reduced weight of the used storage batteries is a further significant advantage for use in mobile portable strapping devices.

Particular advantages can be achieved with lithium ion storage batteries in conjunction with at least one brushless direct current motor as the drive for the tensioner and/or friction welder. This can be further increased by means of a planetary gear system, particularly if the planetary gear system together with the brushless direct current motor and the lithium ion storage batteries are arranged in the drive train for the tensioner and/or friction welder.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

An embodiment of strapping device can also be of independent relevance in which the tensioner and the welding device are only provided with one common drive.

This just one drive can preferably be designed as an electric motor, with the drive movement of which the tensioner and the friction welder can be consecutively driven. Preferably, with this just one motor, not only is the drive movement of the welding procedure itself produced, but also a movement of the friction welder from a rest position into a welding position in which a welding element of the friction weld is pressed onto the layers of strap to be welded and a friction weld is produce through an oscillating movement on the strap layers. Here, the welding element of the friction welder is in active in the rest position and is preferably only started up at the start of movement from the rest position.

In accordance with a further aspect of the present invention, which may also be of independent relevance, the strapping device is provided with means with which the rotational position of the motor shaft or the position of components of the strapping device dependent on the motor shaft can be determined. The information about one or more rotational positions can preferably be used by a control device of the strapping device to control components of the strapping device, such as the friction welder and/or the tensioner. If a brushless direct current motor is used as the drive, this can be done in a particularly simple manner. For their commutation, such motors must determine current positions of the rotating component of the motor, which is generally a rotating anchor. For this, detectors/sensor, such as Hall sensors, are provided, which determine rotational positions of the rotating motor components and make them available to the motor control device. This information can also be used to advantage for control the friction welder.

Thus, in a preferred embodiment of the strapping device it can be envisaged that a number of rotations of the rotating components of the motor are determined in order, on reaching a given value or rotations, to carry out a switching operation. More particularly, this switching operation can involve switching off the friction welder to terminate the production of a friction weld connection. In a further advantageous embodiment of the invention it can be envisaged that at one or at several determined rotational positions the motor is not switched off, or is only switched off at one or more determined rotation positions.

Finally it has proven to be advantageous if a device with a toggle lever system is provided to move the welding device from the rest position into the welding position and back. The levers of the toggle lever joint, which are connected to each other via one joint, can, by overcoming two dead point positions, be brought into both end positions at which they hold the welding device in the rest position or in the welding position. Advantageously the toggle lever device is held in both end positions by a force, preferably a force exerted by a mechanical spring. Only by overcoming this force should the toggle lever device be able to move from one end position into the other. The toggle lever device achieves the advantage that end positions of the welding device are only changed by overcoming comparatively high torques. As this applies especially to the welding position, the toggle lever system contributes to further increasing the functional reliability of the strapping device. Furthermore, the toggle lever system advantageously supplements the drive train of the strapping device, which in one form of embodiment of the invention also has a brushless motor and a planetary gear system in addition to the toggle lever system, for automated movement of the welding device into its welding position, as all the components are able to produce high torques or carry out movements when high torques are applied.

Further preferred embodiments of the invention are set out in the claims, the description and the drawing.

The invention will be described in more detail by way of the examples of embodiment which are shown purely schematically.

Figure 1:
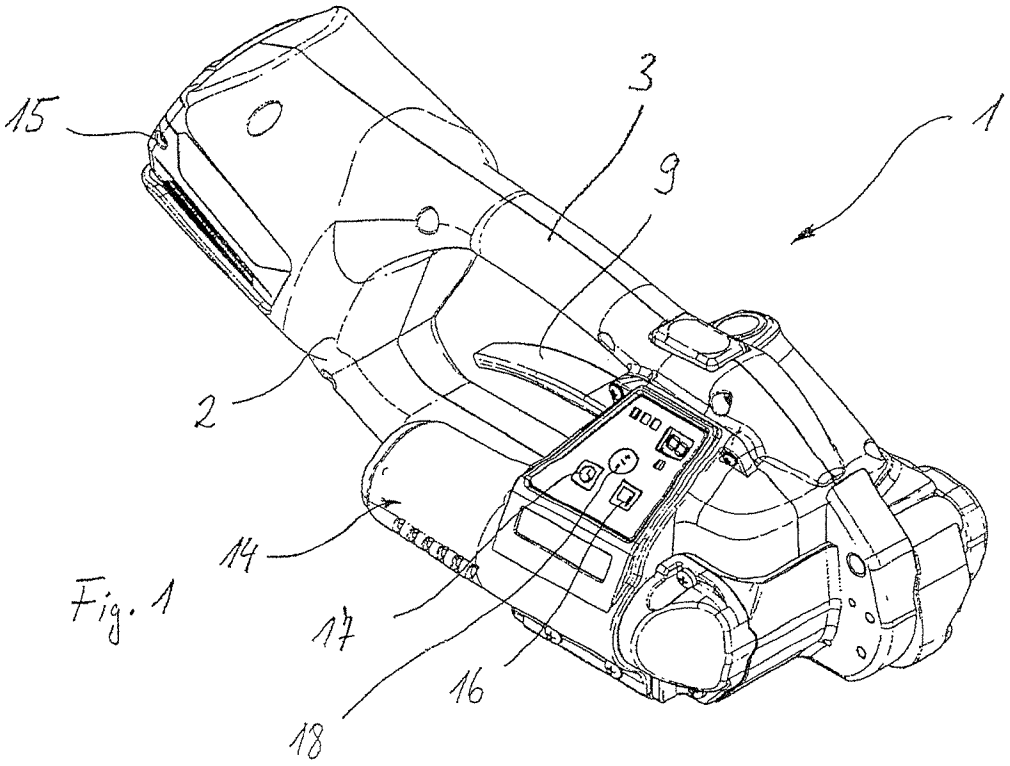
FIG. 1 is a perspective view of a strapping device in accordance with the invention.
Figure 2:
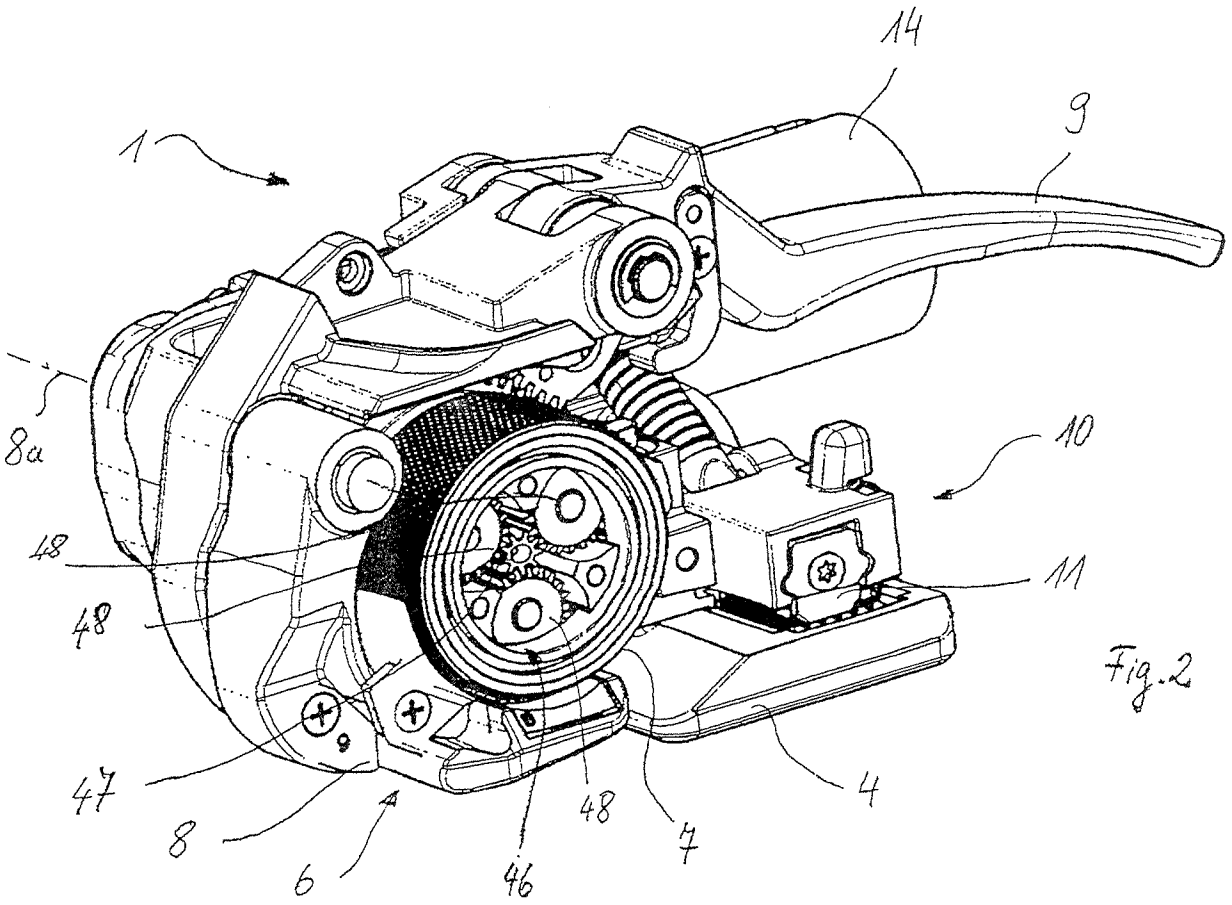
FIG. 2 shows the strapping device in FIG. 1 with the casing.
Figure 10:
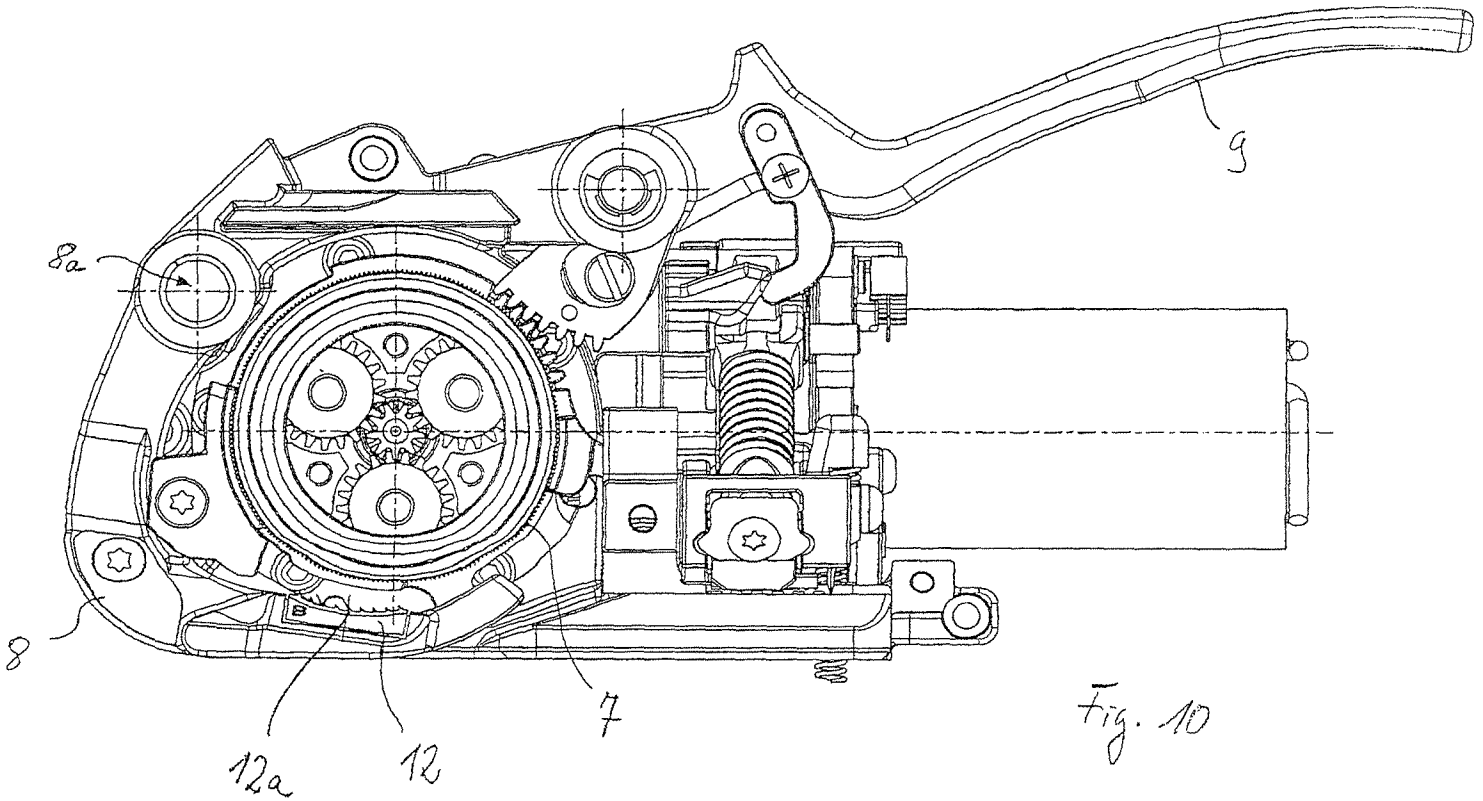
FIG. 10 shows a side view of the tensioner of the strapping device without the casing, in which a tensioning rocker is in a rest position.
Figure 13:
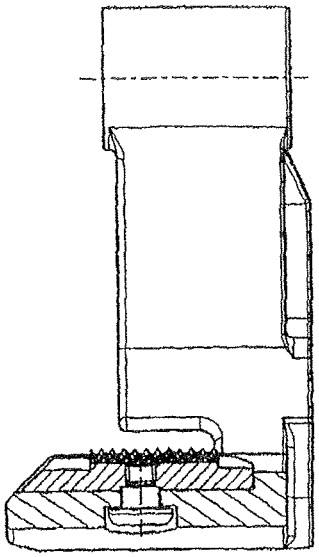
Figure 12:
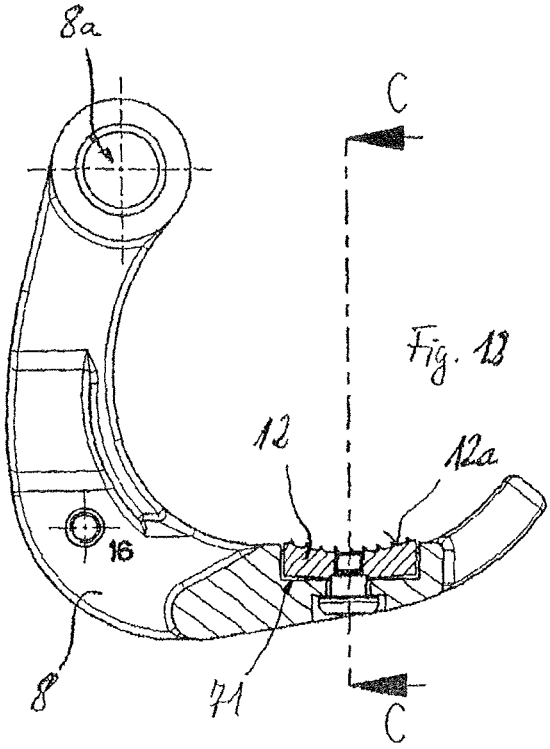
Figure 14:
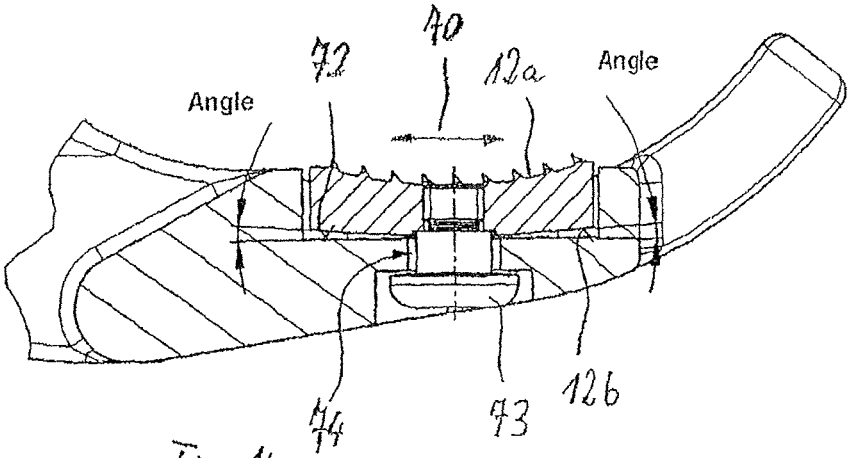

FIG. 12 a side view of the tensioning rocker of the strapping device in FIG. 10 shown in a partial section;

FIG. 13 shows a front view of the tensioning rocker in FIG. 12;

FIG. 14 shows a detail from FIG. 12 along line C-C;

The exclusively manually operated strapping device 1 in accordance with the invention shown in FIGS. 1 and 2 has a casing 2, surrounding the mechanical system of the strapping device, on which a grip 3 for handling the device is arranged. The strapping device also has a base plate 4, the underside of which is intended for placing on an object to be packed. All the functional units of the strapping device 1 are attached on the base place 4 and on the carrier of the strapping device which is connected to the base plate and is not shown in further detail.

With the strapping device 1 a loop of plastic strap, made for example of polypropylene (PP) or polyester (PET), which is not shown in more detail in FIG. 1 and which has previously been placed around the object to be packed, can be tensioned with a tensioner 6 of the strapping device. For this the tensioner has a tensioning wheel 7 with which the strap can be held for a tensioning procedure. The tensioning wheel 7 operates in conjunction with a rocker 8, which by means of a rocker lever 9 can be pivoted from an end position at a distance from the tensioning wheel into a second end position about a rocker pivoting axis 8*a*, in which the rocker 8 is pressed against the tensioning wheel 7. The strap located between the tensioning wheel 7 and the rocker 8 is also pressed against the tensioning wheel 7. By rotating the tensioning wheel 7 it is then possible to provide the strap loop with a strap tension that is high enough for the purpose of packing. The tensioning procedure, and the rocker 8 advantageously designed for this, is described in more detail below.

Subsequently, at a point on the strap loop on which two layers of the wrapping strap are disposed one on top of the other, welding of the two layers can take place by means of the friction welder 8 of the strapping device. In this way the strap loop can be durably connected. For this the friction welder 10 is provided with a welding shoe 11, which through mechanical pressure on the wrapping strap and simultaneous oscillating movement at a predefined frequencies starts to melt the two layers of the wrapping strap. The plastified or melted areas flow into each other and after cooling of the strap a connection is formed between the two strap layers. If necessary the strap loop can be separated from a strap storage roll by means of a strapping device 1 cutter which is not shown.

Operation of the tensioner 6, assignment of the friction welder 10 by means of a transitioning device (FIG. 6) of the friction welder as well as the operation of the friction welder itself and operation of the cutter all take place using only one common electric motor 14, which provides a drive movement for each of these components. For its power supply, an interchangeable storage battery 15, which can be removed for charging, is arranged on the strapping device. The supply of other external auxiliary energies, such as compressed air or additional electricity, is not envisaged in accordance with FIGS. 1 and 2.

The portable mobile strapping device 1 has an operating element 16, in the form of a press switch, which is intended for starting up the motor. Via a switch 17, three operating modes can be set for the operating element 16. In the first mode by operating the operating element 16, without further action being required by the operator, the tensioner 6 and the friction welder 10 are started up consecutively and automatically. To set the second mode the switch 17 is switched over to a second switching mode. In the second possible operating mode, by operating the operating element 15, only the tensioner 6 is started up. To separately start the friction welder 10 a second operating element 18 must be activated by the operator. In alternative forms of embodiment it can also be envisaged that in this mode the first operating element 16 has to be operated twice in order to activate the friction welder. The third mode is a type of semi-automatic operation in which the tensioning button 16 must be pressed until the tension force/tensile force which can preset in stages is achieved in the strap. In this mode it is possible to interrupt the tensioning process by releasing the tensioning button 16, for example in order to position edge protectors on the goods to be strapped under the wrapping strap. By pressing the tensioning button the tensioning procedure can then be continued. This third mode can be combined with a separately operated as well as an automatic subsequent friction welding procedure.

Figure 3:
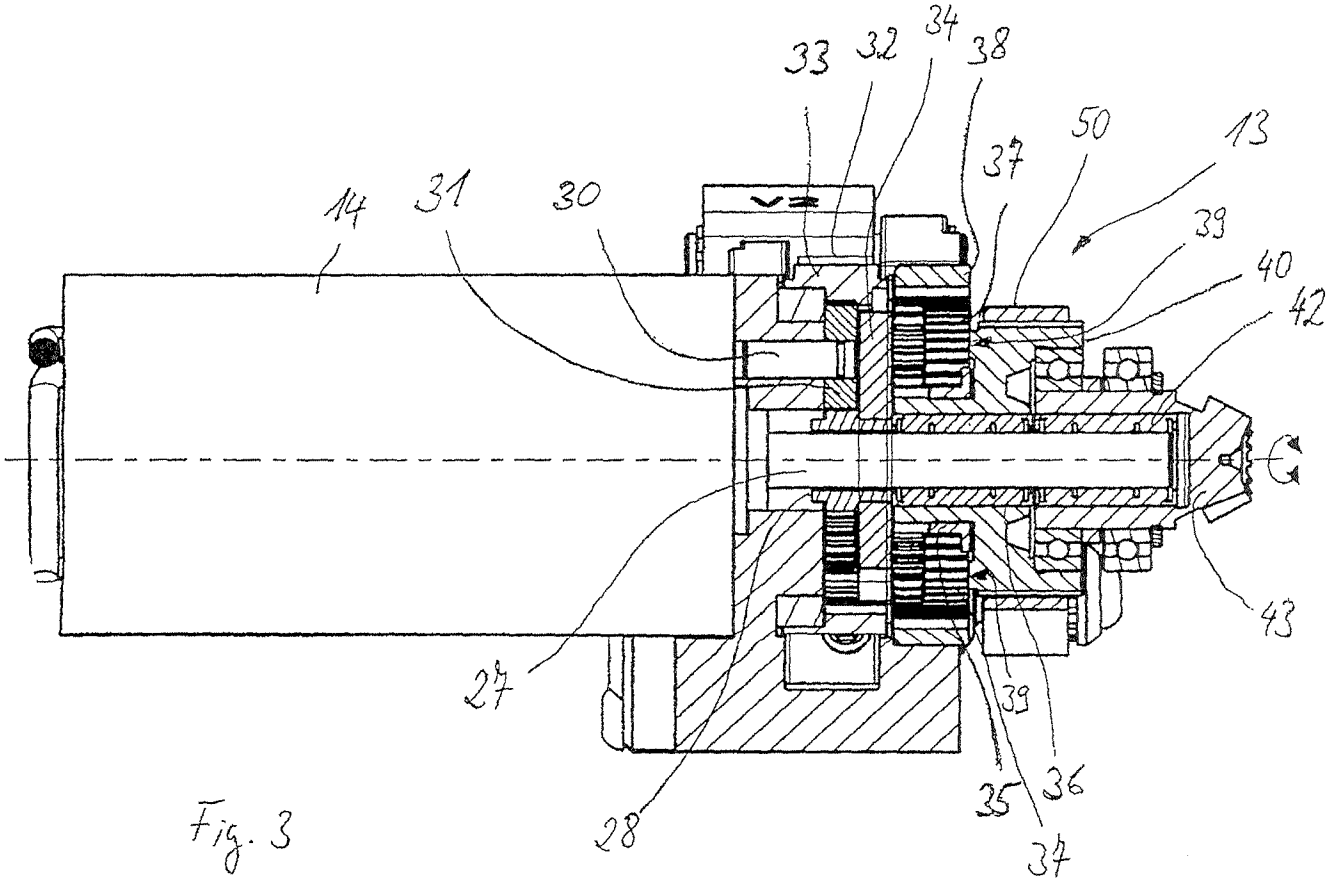
FIG. 3 shows a partial section view of the motor of the strapping device in FIG. 1, together with components arranged on the motor shaft.

On a motor shaft 27, shown in FIG. 3, of the brushless, grooved rotor direct current motor 14 a gearing system device 13 is arranged. In the example of embodiment shown here a type EC140 motor manufactured by Maxon Motor AG, Brünigstrasse 20, 6072 Sachseln is used. The brushless direct current motor 14 can be operated in both rotational directions, whereby one direction is used as the drive movement of the tensioner 6 and the other direction as the drive movement of the welding device 10.

Figure 4:
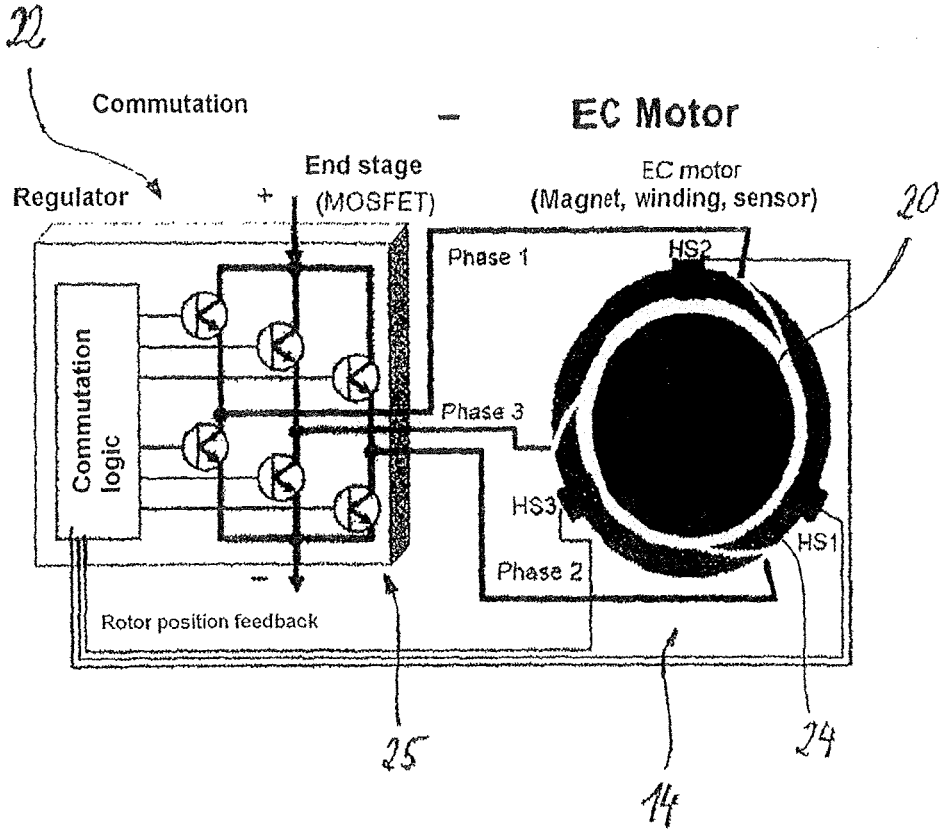
FIG. 4 shows a very schematic view of the motor along with its electronic commutation switch.

The brushless direct current motor 14, shown purely schematically in FIG. 4, is designed with a grooved rotor 20 with three Hall sensors HS1, HS2, HS3. In its rotor 20, this EC motor (electronically commutated motor) has a permanent magnet and is provided with an electronic control 22 intended for electronic commutation in the stator 24. Via the Hall sensors, HS1, HS2, HS3, which in the example of embodiment also assume the function of position sensors, the electronic control 22 determines the current position of the rotor and controls the electrical magnetic field in the windings of the stator 24. The phases (phase 1, phase 2, phase 3) can thus be controlled depending in the position of the rotor 20, in order to bring about a rotational movement of the rotor in a particular rotational direction with a predeterminable variable rotational speed and torque. In this present case a "1$^{st}$ quadrant motor drive intensifier" is used, which provides the motor with the voltage as well as peak and continuous current and regulates these. The current flow for coil windings of the stator 24, which are not shown in more detail, is controlled via a bridge circuit 25 (MOSFET transistors), i.e. commutated. A temperature sensor, which is not shown in more detail, is also provided on the motor. In this way the rotational direction, rotational speed, current limitation and temperature can be monitored and controlled. The commutator is designed as a separate print component and is accommodated in the strapping device separately from the motor.

The power supply is provided by the lithium-ion storage battery 15. Such storage batteries are based on several independent lithium ion cells in each of which essentially separate chemical processes take place to generate a potential difference between the two poles of each cell. In the example of embodiment the lithium ion storage battery is manufactured by Robert Bosch GmbH, D-70745 Leinfelden-Echterdingen. The battery in the example of embodiment has eight cells and has a capacity of 2.6 ampere-hours. Graphite is used as the active material/negative electrode of the lithium ion storage battery. The positive electrode often has lithium metal oxides, more particularly in the form of layered structures. Anhydrous salts, such as lithium hexafluorophosphate or polymers are usually used as the electrolyte. The voltage emitted by a conventional lithium ion storage battery is usually 3.6 volts. The energy density of such storage batteries is around 100 Wh/kh-120 Wh/kg.

On the motor side drive shaft, the gearing system device 13 has a free wheel 36, on which a sun gear 35 of a first planetary gear stage is arranged. The free wheel 36 only transfers the rotational movement to the sun gear 35 in one of the two possible rotational directions of the drive. The sun gear 35 meshes with three planetary gears 37 which in a known manner engage with a fixed gear 38. Each of the planetary gears 37 is arranged on a shaft 39 assigned to it, each of which is connected in one piece with an output gear 40. The rotation of the planetary gears 37 around the motor shaft 27 produces a rotational movement of the output gear 40 around the motor shaft 27 and determines a rotational speed of this rotational movement of the output gear 40. In addition to the sun gear 35 the output gear 40 is also on the free wheel 36 and is therefore also arranged on the motor shaft. This free wheel 36 ensures that both the sun gear 35 and the output gear 40 only also rotate in one rotational direction of the rotational movement of the motor shaft 27. The free wheel 29 can for example be of type INA HFL0615 as supplied by the company Schaeffler KG, D-91074 Herzogenaurach, On the motor-side output shaft 27 the gear system device 13 also has a toothed sun gear 28 belonging to a second planetary gear stage, through the recess of which the shaft 27 passes, though the shaft 27 is not connected to the sun gear 28. The sun gear is attached to a disk 34, which in turn is connected to the planetary gears. The rotational movement of the planetary gears 37 about the motor-side output shaft 27 is thus transferred to the disk 34, which in turn transfers its rotational movement at the same speed to the sun gear 28. With several planetary gears, namely three, the sun gear 28 meshes with cog gears 31 arranged on a shaft 30 running parallel to the motor shaft 27. The shafts 30 of the three cog gears 31 are fixed, i.e. they do not rotate about the motor shaft 27. In turn the cog gears 21 engage with an internal-tooth sprocket, which on its outer side has a cam 32 and is hereinafter referred to as the cam wheel 33. The sun gear 28, the three cog gears 31 as well as the cam wheel 33 are components of the second planetary gear stage. In the planetary gear system the input-side rotational movement of the shaft 27 and the rotational movement of the cam wheel are at a ratio of 60:1, i.e. a 60-fold reduction takes place through the second-stage planetary gear system.

At the end of the motor shaft 27, on a second free wheel 42 a bevel gear 43 is arranged, which engages in a second bevel gear, which is not shown in more detail. This free wheel 42 also only transmits the rotational movement in one rotational direction of the motor shaft 27. The rotational direction in which the free wheel 36 of the sun gear 35 and the free wheel 42 transmit the rotational movement of the motor shaft 27 is opposite. This means that in one rotational direction only free wheel 36 turns, and in the other rotational direction only free wheel 42.

The second bevel gear is arranged on one of a, not shown, tensioning shaft, which at its other end carries a further planetary gear system 46 (FIG. 2). The drive movement of the electric motor in a particular rotational direction is thus transmitted by the two bevel gears to the tensioning shaft. Via a sun gear 47 as well as three planetary gears 48 the tensioning wheel 49, in the form of an internally toothed sprocket, of the tensioner 6 is rotated. During rotation the tensioning wheel 7, provided with a surface structure on its outer surface, moves the wrapping strap through friction, as a result of which the strap loop is provided with the envisaged tension.

Figure 5:
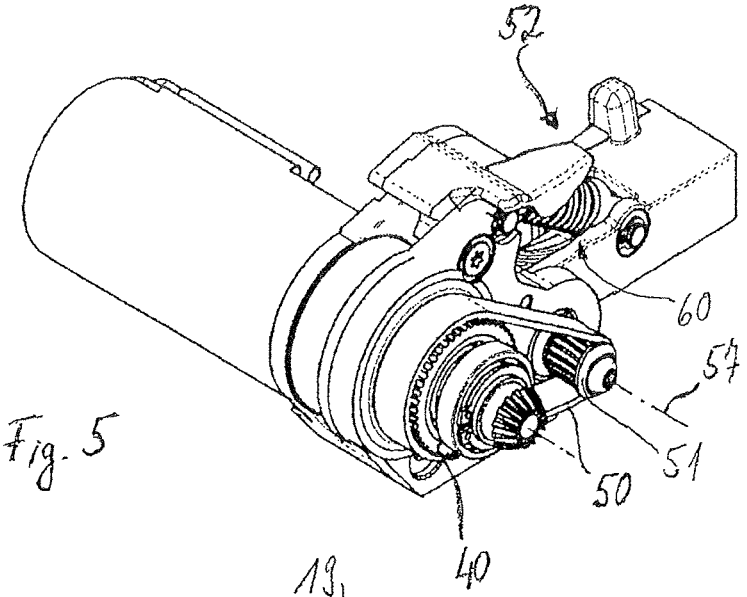
FIG. 5 shows a perspective partial view of the drive train of the strapping device in FIG. 1.
Figure 6:
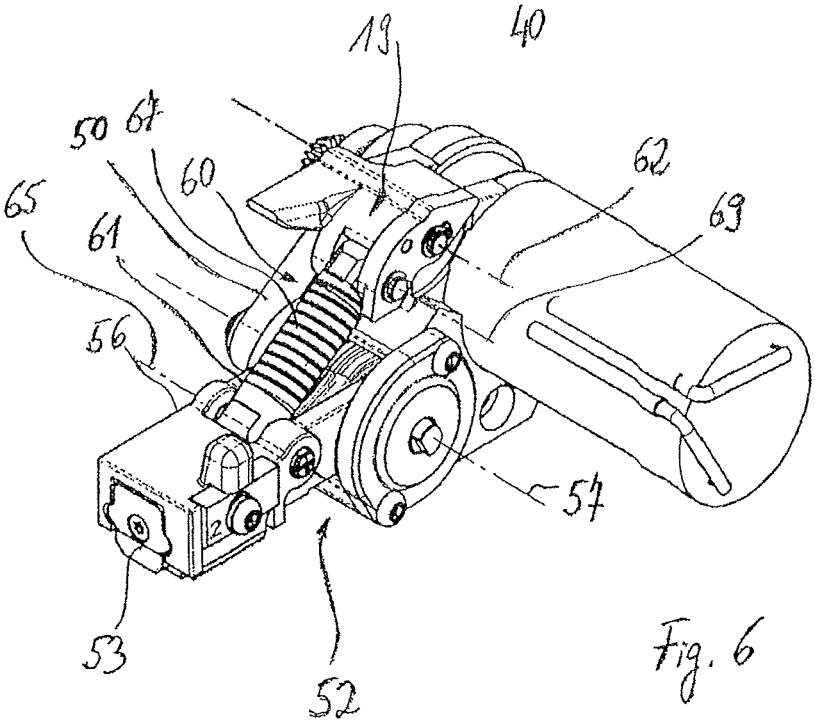
FIG. 6 shows the drive train in FIG. 5 from another direction of view.

In the area of its outer circumference the output gear 40 is designed as a cog gear on which is a toothed belt of an envelope drive (FIGS. 5 and 6). The toothed belt 50 also goes round pinion 51, smaller in diameter than the output gear 40, the shaft of which drive an eccentric drive 52 for producing an oscillating to and fro movement of the welding shoe 53. Instead of toothed belt drive any other form of envelope drive could be provided, such as a V-belt or chain drive. The eccentric drive 52 has an eccentric shaft 54 on which an eccentric tappet 55 is arranged on which in turn a welding shoe arm 56 with a circular recess is mounted. The eccentric rotational movement of the eccentric tappet 55 about the rotational axis 57 of the eccentric shaft 54 results in a translator oscillating to and fro movement of the welding shoe 53. Both the eccentric drive 52 as well as the welding shoe 53 it can be designed in any other previously known manner.

Figure 9:
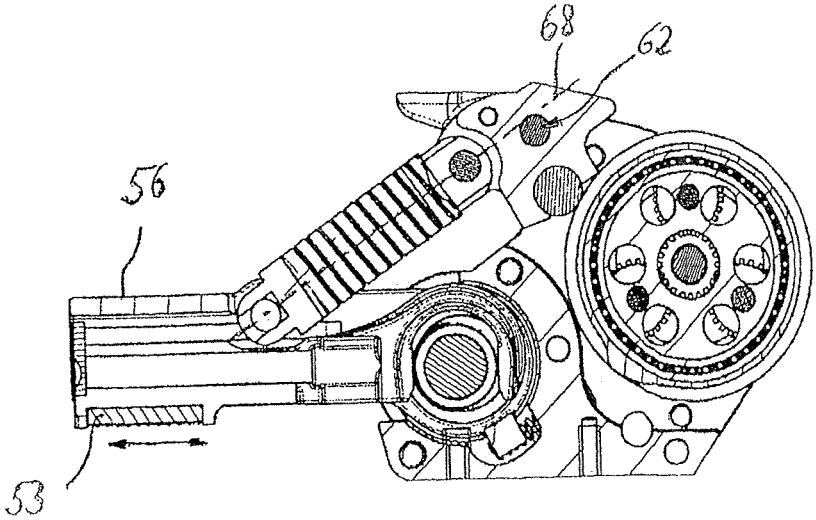
FIG. 9 shows a side view of the drive train in FIG. 5 with the welding device in a welding position.

The welding device is also provided with a toggle lever device 60, by means of which the welding device can be moved from a rest position (FIG. 7) into a welding position (FIG. 9). The toggle lever device 60 is attached to the welding shoe arm 56 and provided with a longer toggle lever 61 privotably articulated on the welding shoe arm 56. The toggle lever device 60 is also provided with a pivoting element 63, pivotably articulated about a pivoting axis 62, which in the toggle level device 60 acts as the shorter toggle lever. The pivoting axis 62 of the pivoting element 63 runs parallel to the axes of the motor shaft 27 and the eccentric shaft 57.

Figure 7:
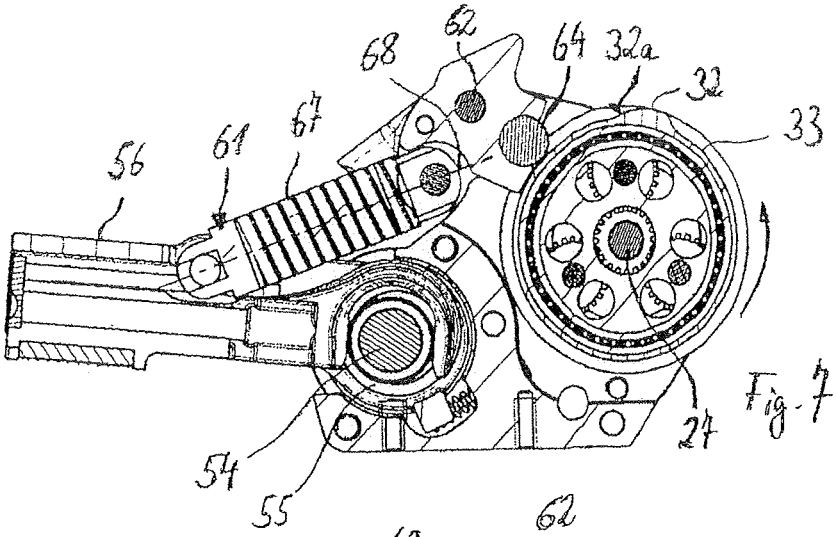
FIG. 7 shows a side view of the drive train in FIG. 5 with the welding device in the rest position.
Figure 8:
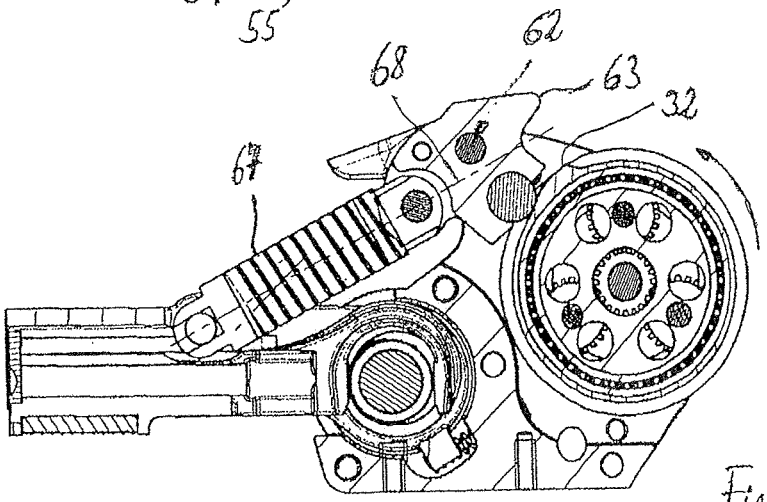
FIG. 8 shows a side view of the drive train in FIG. 6 with the welding device in a position between two end positions.

The pivoting movement is initiated by the cam 32 on the cam wheel 33 which during rotational movement in the anticlockwise direction—in relation to the depictions in FIGS. 7 to 9—of the cam wheel 33 ends up under the pivoting element 63 (FIG. 8). A ramp-like ascending surface 32*a* of the cam 32 comes into contact with a contact element 64 set into the pivoting element 63. The pivoting element 63 is thus rotated clockwise about its pivoting axis 62. In the area of a concave recess of the pivoting element 63 a two-part longitudinally-adjustable toggle lever rod of the toggle lever 61 is pivotably arranged about a pivoting axis 69 in accordance with the 'piston cylinder' principle. The latter is also rotatably articulated on an articulation point 65, designed as a further pivoting axis 65, of the welding shoe arm 56 in the vicinity of the welding shoe 53 and at a distance from the pivoting axis 57 of the welding shoe arm 56. Between both ends of the longitudinally adjustable toggle lever rod a pressure spring 67 is arranged thereon, by means of which the toggle lever 61 is pressed against both the welding shoe arm 56 as well as against the pivoting element 63. In terms of its pivoting movements the pivoting element 63 is thus functionally connected to the toggle lever 61 and the welding shoe arm 56.

As can be seen in the depictions in FIG. 7, in the rest position there is an (imaginary) connecting line 68 for both articulation points of the toggle lever 61 running through the toggle lever 61 between the pivoting axis 62 of the pivoting element 63 and the cam wheel 33, i.e. on one side of the pivoting axis 62. By operating the cam wheel 33 the pivoting element 63 is rotated clockwise—in relation to the depictions in FIGS. 7 to 9. In this way the toggle lever 61 of the pivoting 63 is also operated. In FIG. 8 an intermediate position of the toggle lever 61 is shown in which the connecting line 68 of the articulation points 65, 69 intersects the pivoting axis 62 of the pivoting element 63. In the end position of the movement (welding position) shown in FIG. 9 the toggle lever 61 with its connecting line 68 is then on the other side of the pivoting axis 62 of the pivoting element 63 in relation to the cam wheel 33 and the rest position. During this movement the welding arm shoe 56 is transferred by the toggle lever 61 from its rest position into the welding position by rotation about the pivoting axis 57. In the latter position the pressure spring 67 presses the pivoting element 63 against a stop, not shown in further detail, and the welding shoe 53 onto the two strap layers to be welded together. The toggle lever 61, and therefore also the welding shoe arm 56, is thus in a stable welding position.

The anticlockwise drive movement of the electric motor shown in FIGS. 6 and 9 is transmitted by the toothed belt 50 to the welding shoe 53, brought into the welding position by the toggle lever device 60, which is pressed onto both strap layer and moved to and fro in an oscillating movement. The welding time for producing a friction weld connection is determined by way of the adjustable number of revolutions of the cam wheel 33 being counted as of the time at which the cam 32 operates the contact element 64. For this the number of revolutions of the shaft 27 of the brushless direct current motor 14 is counted in order to determine the position of the cam wheel 33 as of which the motor 14 should switch off and thereby end the welding procedure. It should be avoided that on switching off the motor 14 the cam 32 comes to a rest under the contact element 64. Therefore, for switching off the motor 14 only relative positions of the cam 32 with regard to the pivoting element 63 are envisaged, a which the cam 32 is not under the pivoting element. This ensures that the welding shoe arm 56 can pivot back from the welding position into the rest position (FIG. 7). More particularly, this avoids a position of the cam 32 at which the cam 32 would position the toggle lever 61 at a dead point, i.e. a position in which the connecting line 68 of the two articulation points intersects the pivoting axis 62 of the pivoting element 63—as shown in FIG. 8. As such a position is avoided, by means of operating the rocker lever the rocker (FIG. 2) can be released from the tensioning wheel 7 and the toggle lever 61 pivoted in the direction of the cam wheel 33 into the position shown in FIG. 7. After the strap loop has been taken out of the strapping device, the latter is ready for a further strapping procedure.

The described consecutive procedures "tensioning" and "welding" can be jointly initiated in one switching status of the operating element 15. For this the operating element 16 is operated once, whereby the electric motor 14 first turns on the first rotational direction and thereby (only) the tensioner 6 is driven. The strap tension to be applied to the strap can be set on the strapping device, preferably be means of a push button in nine stages, which correspond to nine different strap tensions. Alternatively continuous adjustment of the strap tension can be envisaged. As the motor current is dependent on the torque of the tensioning wheel 7, and this in turn on the current strap tension, the strap tension to be applied can be set via push buttons in nine stages in the form of a motor current limit value on the control electronics of the strapping device.

After reaching a settable and thus predeterminable limit value for the motor current/strap tension, the motor 14 is switched off by its control device 22. Immediately afterwards the control device 22 operates the motor in the opposite rotational direction. As a result, in the manner described above, the welding shoe is lowered onto the two layers of strap displaced one on top of the other and the oscillating movement of the welding shoe is carried out to produce the friction weld connection.

By operating switch 17 the operating element 16 can only activate the tensioner. If this is set, by operating the operating element only the tensioner is brought into operation and on reaching the preset strap tension is switched off again. To start the friction welding procedure the second operating element 18 must be operated. However, apart from separate activation, the function of the friction welding device is identical the other mode of the first operating element.

Figure 11:
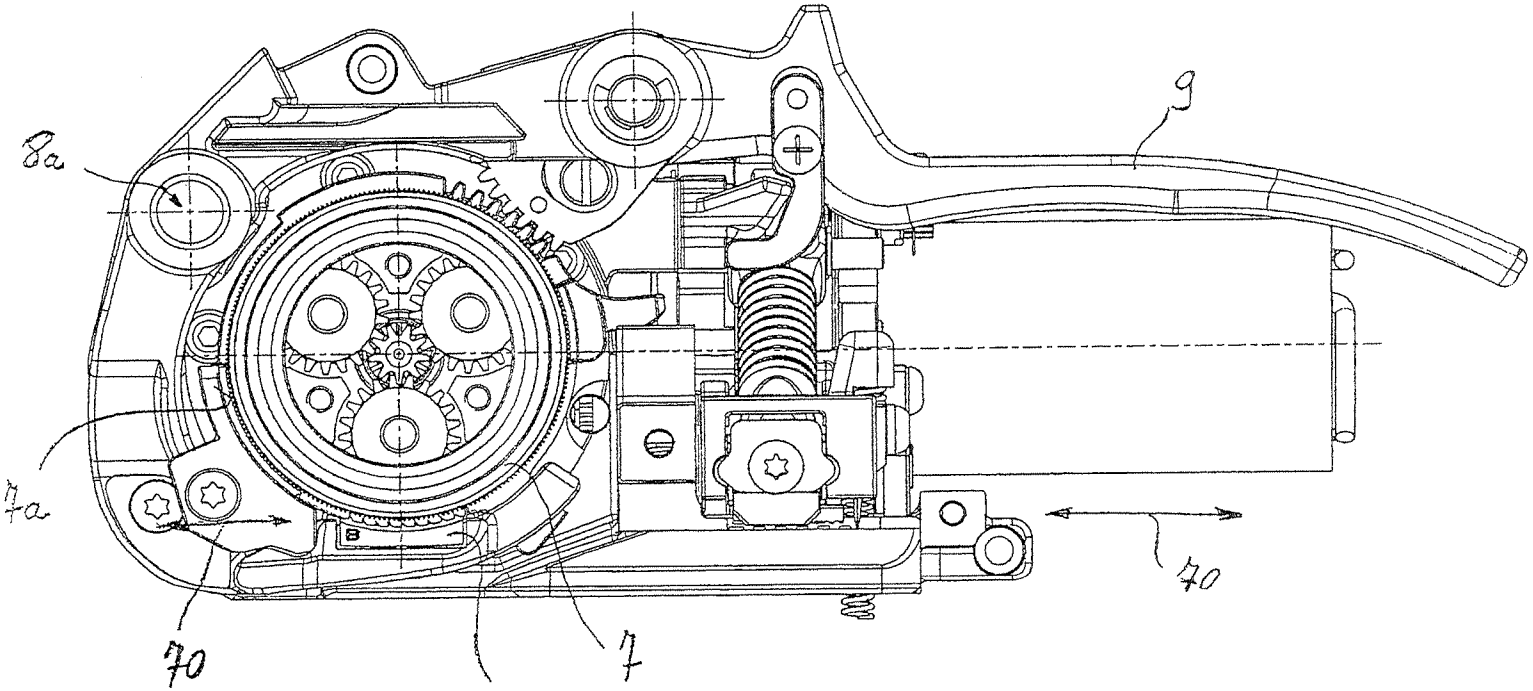
FIG. 11 shows a side view of the tensioner of the strapping device without the casing in which a tensioning rocker is in a tensioning position.

As has already been explained, the rocker 8 can through operating the rocker lever 9 shown in FIGS. 2, 10, 11 carry out pivoting movements about the rocker axis 8*a*. For this, the rocker is moved by a rotating cam disc which is behind the tensioning wheel 7 and cannot therefore be seen in FIG. 2. Via the rocker lever 9 the cam disc can carry out a rotational movement of approx. 30° and move the rocker 8 and/or the tensioning plate 12 relative to the tensioning wheel 7 which allow the strap to be inserted into the strapping device/between the tensioning wheel 7 and tensioning plate 12.

In this way, the toothed tensioning plate arranged on the free end of the rocker can be pivoted from a rest position shown in FIG. 10 into a tensioning position shown in FIG. 11 and back again. In the rest position the tensioning plate 12 is at sufficiently great distance from the tensioning wheel 7 that a wrapping strap can be placed in two layers between the tensioning wheel and the tensioning plate as required for producing connection on a strap loop. In the tensioning position the tensioning plate 12 is pressed in a known way, for example by means of a spring force acting on the rocker, against the tensioning wheel 7, whereby, contrary to what is shown in FIG. 11, in a strapping procedure the two-layer strap is located between the tensioning plate and the tensioning wheel and thus there should be no contact between the two latter elements. The toothed surface 12*a* (tensioning surface) facing the tensioning wheel 7 is concavely curved whereby the curvature radius corresponds with the radius of the tensioning wheel 7 or is slightly larger.

As can be seen in particular in FIGS. 10 and 11 as well as the detailed drawings of FIGS. 12-14, the toothed tensioning plate 12 is arranged in a grooved recess 71 of the rocker. The length—in relation to the direction of the strap—of the recess 71 is greater than the length of the tensioning plate 12. In addition, the tensioning plate 12 is provide with a convex contact surface 12*b* with which it is arranged on a flat contact surface 71 in the recess 71 of the rocker 8. As shown in particular in FIGS. 11 and 12 the convex curvature runs in a direction parallel to the strap direction 70, while the contact surface 12*b* is designed flat and perpendicular to this direction (FIG. 13). As a result of this design the tensioning plate 12 is able to carry out pivoting movements in the strap direction 70 relative to the rocker 8 and to the tensioning wheel 7. The tensioning plate 12 is also attached to the rocker 8 by means of a screw 72 passing through the rocker from below. This screw is in an elongated hole 74 of the rocker, the longitudinal extent of which runs parallel to the course of the strap 70 in the strapping device. As a result in addition to be pivotable, the tensioning plate 12 is also arranged on the rocker 8 in a longitudinally adjustable manner.

In a tensioner the tensioning rocker 8 is initially moved from the rest position (FIG. 10) into the tensioning position (FIG. 11). In the tensioning position the sprung rocker 8 presses the tensioning plate in the direction of the tensioning wheel and thereby clamps the two strap layers between the tensioning wheel 7 and the tensioning plate 12. Due to different strap thicknesses this can result in differing spacings between the tensioning plate 12 and circumferential surface 7*a* of the tensioning wheel 7. This not only results in different pivoting positions of the rocker 8, but also different positions of the tensioning plate 12 in relation to the circumferential direction of the tensioning wheel 7. In order to still achieve uniform pressing conditions, during the pressing procedure the tensioning plate 12 adjusts itself to the strap through a longitudinal movement in the recess 71 as well as a pivoting movement via the contact surface 12*b* on contact surface 72 so that the tensioning plate 12 exerts as even a pressures as possible over its entire length on the wrapping strap. If the tensioning wheel 7 is then switched on the toothing of tensioning plate 12 holds the lower strap layer fast, while the tensioning wheel 7 grasps the upper strap layer with its toothed circumferential surface 7*a*. The rotational movement of the tensioning wheel 7 as well the lower coefficient of friction between the two strap layers then results in the tensioning wheel pulling back the upper band layer, thereby increasing the tension in the strap loop up to the required tensile force value.

LIST OF REFERENCES

1. Strapping device 1
2. Casing
3. Grip
4. Base plate
6. Tensioner
7. Tensioning wheel
7*a*. Circumferential surface
8. Rocker
8. Rocker pivoting axis
9. Rocker lever
10. Friction welder
11. Welding shoe
12. Tensioning plate
12*a*. Tensioning surface system
12*b*. Contact surface
13. Gear system device
14. Electric direct current motor
15. Storage battery
16. Operating element
17. Switch
18. Operating element
19. Transmission device
20. Rotor
HS1 Hall sensor
HS2 Hall sensor eccentric shaft
HS3 Hall sensor device
22. Electronic control lever
24. Stator
25. Bridging circuit
27. Motor side output shaft
28. Sun gear
30. Shaft
31. Cog wheel
32. Cam

32*a*. Surface
33. Cam wheel
35. Sun gear
36. Free wheel
37. Planetary gear
38. Socket
39. Shaft
40. Output gear
42. Free wheel
43. Bevel gear
46. Planetary gear
47. Sun gear
48. Planetary gear
49. Tensioning wheel
50. Toothed belt
51. Pinion
52. Eccentric drive
53. Welding shoe
54. Eccentric shaft
55. Eccentric tappet
56. Welding shoe arm
57. Rotational axis
60. Toggle lever
61. Longer toggle
62. Pivoting axis
63. Pivoting element
64. Contact element
65. Pivoting axis
66. Pivoting axis
67. Pressure spring
68. Connecting line
69. Pivoting axis
70. Strap direction
71. Recess
72. Contact surface
73. Screw
74. Elongated hole

The invention claimed is:

1. A mobile strapping device for strapping packaged goods with a loop of wrapping strap, comprising a tensioner for applying a strap tension to the loop of wrapping strap; a connector for producing a friction weld connection at two areas of the loop of wrapping strap disposed one on top of the other by way of reciprocating movement of a friction welding element; a motor operatively coupled to the tensioner for driving the tensioner; a planetary gear system operatively coupled to the motor and the connector for transferring drive movements of the motor to the connector to cause the reciprocating movement of the friction welding element; a chargeable energy storage device including a lithium ion storage battery for storing energy that can power the motor; and an output device for outputting an indication when the energy stored by the energy storage device is no longer suitable to enable the connector to produce a friction weld of a designated quality.

2. The mobile strapping device in accordance with claim 1, wherein the motor is a brushless direct current motor.

3. The mobile strapping device in accordance with claim 1, which is configured to automatically switch off the motor.

4. The mobile strapping device in accordance with claim 3, which includes means for determining a rotational position of a motor shaft of the motor or a position of an element in a drive train of the connector dependent on the position of the motor shaft.

5. The mobile strapping device in accordance with claim 4, which includes at least one detector arranged on the motor for determining the rotational position of the motor shaft.

6. The mobile strapping device in accordance with claim 5, which includes a plurality of detectors for determining the rotational position of the motor shaft, which are also components of a circuit for controlling electronically produced commutation of the motor.

7. The mobile strapping device in accordance with claim 1, wherein a duration of a welding cycle can be set during which the connector is in use, whereby the duration can be predetermined depending on a number of rotations of the motor.

8. The mobile strapping device in accordance with claim 1, wherein the connector includes a toggle lever which can be pivoted between two end positions, whereby one end position of the toggle lever determines a friction welding position and the other end position a rest position in which the connector is not in use.

9. The mobile strapping device in accordance with claim 1, which is configured to operate according to a rotational speed-controlled tensioning cycle of the tensioner, during which the motor is at least at times operated at different rotational speeds at a substantially constant torque.

10. The mobile strapping device in accordance with claim 1, wherein the connector is a friction welder.

11. The mobile strapping device in accordance with claim 10, wherein the device is configured such that a duration of a welding cycle, during which the friction welder is in use, can be adjusted, whereby the duration can be predetermined depending on a number of revolutions of the motor.

12. A mobile strapping device for strapping packaged goods with a loop of wrapping strap, comprising:

a tensioner configured to apply a strap tension to the loop of wrapping strap;

a connector configured to produce a friction weld connection at two areas of the loop of wrapping strap disposed one on top of the other by way of reciprocating movement of a friction welding element;

a motor operatively coupled to the tensioner to drive the tensioner;

a planetary gear system operatively coupled to the motor and the connector to transfer drive movements of the motor to the connector to cause the reciprocating movement of the friction welding element;

a chargeable energy storage device configured to store energy that can power the motor; and an output device configured to output an indication when the energy stored by the energy storage device is no longer suitable to enable the connector to produce a friction weld of a designated quality.

13. The mobile strapping device in accordance with claim 12, further comprising a system configured to automatically switch off the motor.

14. The mobile strapping device in accordance with claim 13, further including a system configured to determine a rotational position of a motor shaft of the motor or a position of an element arranged in a drive train of the connector dependent on the position of the motor shaft.

15. The mobile strapping device in accordance with claim 12, which is configured to operate according to a rotational speed-controlled tensioning cycle of the tensioner, during which the motor is at least at times operated at different rotational speeds a substantially constant torque.

16. The mobile strapping device in accordance with claim 12, wherein the chargeable energy storage device includes a lithium ion battery.

17. A method, comprising:

strapping a packaged good with a loop of wrapping strap utilizing a mobile storage battery-driven strapping device, including:

placing the loop of wrapping strap around the packaged good;

driving a motor, which is operatively connected to a tensioner of the strapping device, to cause the tensioner to apply a strap tension to the loop; and driving the motor, which is operatively connected to a connector of the strapping device via a planetary gear system, to cause the connector to form a connection at two areas of the loop of the wrapping strap disposed one on top of the other by way of reciprocating movement of a friction welding element, wherein the planetary gear system transfers drive movements of the motor to the connector to cause the reciprocating movement, wherein the strap tension is applied by the strapping device and the connection is established by the strapping device utilizing energy from a chargeable energy storage device; and when the energy stored by the energy storage device is no longer suitable to enable the connector to form a connection of a designated quality, outputting an indication.

18. The method of claim 17, wherein the chargeable energy storage device includes a lithium ion battery.

* * * * *